United States Patent [19]

DeVore

[11] 4,437,512

[45] Mar. 20, 1984

[54] HEAT EXCHANGER ASSEMBLY

[75] Inventor: Robert F. DeVore, Dallas, Tex.

[73] Assignee: Harsco Corporation, Camp Hill, Pa.

[21] Appl. No.: 444,341

[22] Filed: Nov. 24, 1982

[51] Int. Cl.[3] ..... F24F 13/08

[52] U.S. Cl. ..... 165/122; 165/124; 62/426

[58] Field of Search ..... 62/426; 165/122–128

[56] References Cited

U.S. PATENT DOCUMENTS

| | | | |
|---|---|---|---|
| 1,726,275 | 8/1929 | Modine | 165/124 |
| 2,783,979 | 3/1957 | Blum | 165/123 |
| 3,347,310 | 10/1967 | Lind et al. | 62/426 |
| 3,384,165 | 5/1968 | Mathews . | |
| 3,403,725 | 10/1968 | Miner . | |
| 3,627,037 | 12/1971 | Carr, Jr. | 165/122 |
| 3,628,590 | 12/1971 | Knebusch . | |
| 3,727,679 | 4/1973 | Von Cleve . | |

FOREIGN PATENT DOCUMENTS

| | | | |
|---|---|---|---|
| 607237 | 8/1960 | Italy | 165/123 |

*Primary Examiner*—William R. Cline
*Assistant Examiner*—Theodore W. Streule
*Attorney, Agent, or Firm*—Kerkam, Stowell, Kondracki & Clarke

[57] ABSTRACT

A heat exchange assembly includes an induced draft arrangement for simultaneously inducing drafts in right and left heat exchangers mounted on a common support. A plurality of fans are disposed with a common axis of rotation and draw air through the right and left heat exchangers, the air then being deflected upwardly by a series of venting walls associated with the fans on a one to one basis. The heat exchangers are bolted to support posts along a support and are spaced from the venting walls to maximize heat dissipation capacity.

18 Claims, 6 Drawing Figures

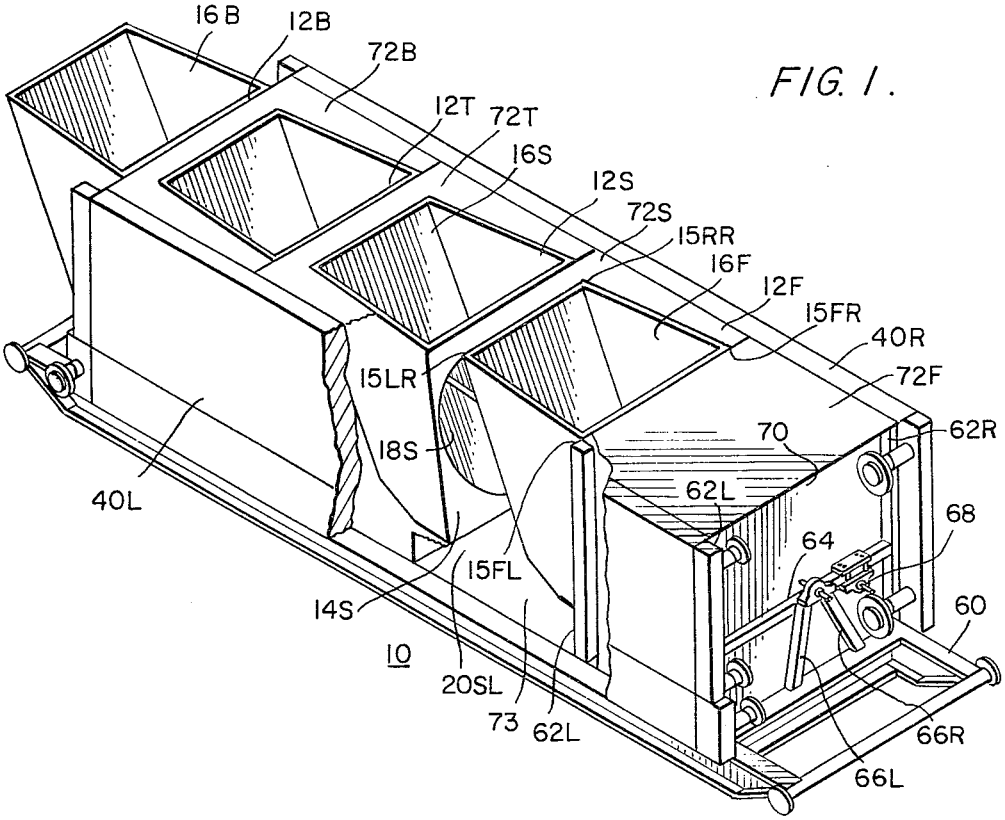
FIG. 1.
FIG. 2.
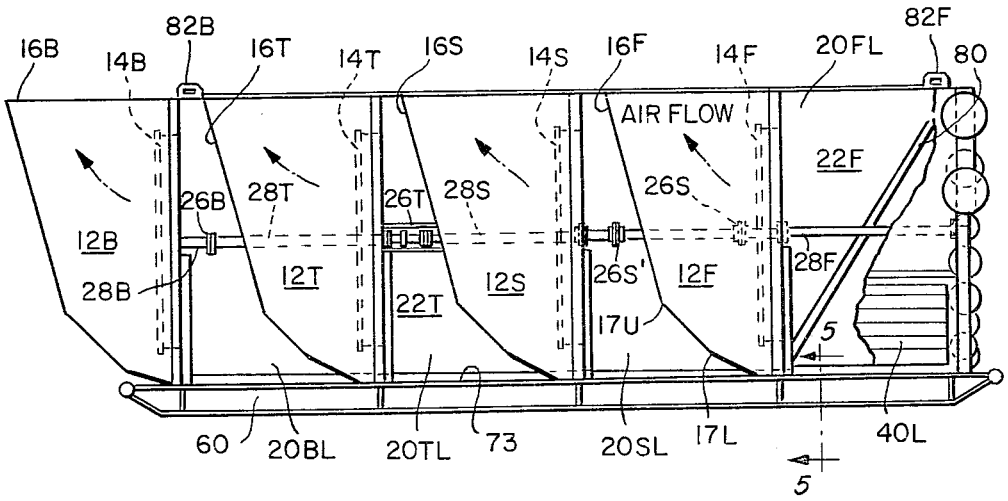

HEAT EXCHANGER ASSEMBLY

BACKGROUND OF THE INVENTION

1. Field of the invention

This invention relates to heat exchanger assemblies. More specifically, this invention relates to air cooled heat exchanger assemblies having a plurality of fans for directing air flow.

2. Description of the prior art

The use of heat exchanger assemblies including a plurality of fans is well known in the art. For example, U.S. Pat. No. 3,627,037 issued to Carr on Dec. 14, 1971 discloses such an arrangement.

The Carr Patent discloses a factory assembled heat exchanger apparatus to permit an increase in the capacity of the heat exchanger without exceeding permissible height and width limits for transportation of the assembled unit on highways and railroads. The apparatus includes a plurality of fans having fan shafts which are in axial alignment and may be coupled for rotation of the fans in unison. The fans are mounted in parallel planes and draw air in from right and left sides of the heat exchanger apparatus. The air which is drawn by each fan is pushed upward by virtue of a separate venting wall associated with each fan such that the air passes through a heat exchanger unit mounted on the top of the length-to-length arrangement of the fans and associated venting walls.

The prior art further includes the following U.S. patents:

| U.S. Pat. No. | Inventor(s) | Date Issued |
|---|---|---|
| 3,384,165 | Mathews | May 21, 1968 |
| 3,403,725 | Miner | Oct. 1, 1968 |
| 3,628,590 | Knebusch | Dec. 21, 1971 |
| 3,727,679 | Von Cleve | Apr. 17, 1973 |

The Mathews Patent discloses a heat exchanger unit including several different fans causing air flow across various heat exchanger sections which are inclined within the body of the unit. Air flow is induced across some of the heat exchangers by a fan, whereas air is also forced across heat exchangers by another fan. The fans blow straight up or straight down.

The Miner Patent discloses a fan arrangement including a number of axially aligned fans with deflectors or venting walls associated to push air upwardly. Alternate embodiments show a heat exchanger having air forced through it by the fans and a heat exchanger having air induced to flow through it by the fans.

The Knebusch Patent discloses a heat exchanger unit having two separate coil sections slanted within the body of the unit. Alternate embodiments use a blower for inducing air flow across a cooler and for forcing air through a cooler.

The Von Cleve Patent discloses a heat exchanger including alternate constructions whereby fans may be used for either induced or forced air circulation. The heat exchanger sections are inclined relative to the fans.

Although the prior art has provided generally useful heat exchanger assemblies, they have generally been subject to a number of disadvantages. For example, a heat exchanger assembly may require excessive volume if it is desired to increase its capacity beyond certain limits. Limitations in the cooling capacity per unit volume of the assembly have generally resulted in excessively large structures when large quantities of heat must be dissipated.

The above discussed Carr Patent discloses a heat exchanger assembly having a relatively high heat dissipation capacity, but still remaining sufficiently small to allow it to be transported by highway and railroad. Although this has lessened the capacity and volume problems discussed above, the capacity of this heat exchanger assembly is still somewhat limited due to the size considerations.

OBJECTS OF THE INVENTION

Accordingly, it is an object of the present invention to provide a new and improved heat exchanger assembly.

A more specific object of the present invention is to provide a heat exchanger assembly having a high capacity without requiring excess volume.

A further object of the present invention is to provide a heat exchanger which may be factory assembled in a size sufficiently small to allow it to be transported on railroads and highways without exceeding limits as to volume, height, width, and/or length.

Yet another object of the present invention is to provide a heat exchanger assembly satisfying the objects of the above-discussed Carr Patent and having its advantages, while providing still higher capacity heat dissipation.

SUMMARY OF THE INVENTION

These and other objects of the present invention are realized by a heat exchanger assembly for air cooled heat exchanging, which assembly has a top, a bottom, a front end, a back end, a right side, and a left side and comprises a plurality of air flow units arranged and supported in longitudinal end to end assembly, each air flow unit including the following associated components: a substantially vertical fan mounting wall having a hole therein, a fan mounted for rotation in the hole, a venting wall operative to direct air blown backwardly by the fan up and out the top, the venting wall situated in back of the fan mounting wall and including right and left portions and an inclined portion extending from adjacent the bottom of the fan mounting wall to the top of the heat exchanger assembly, right and left air inlets situated in front of the fan mounted wall, an air inlet zone between the right and left air inlets from which air is drawn to the fan, through the hole, and into a venting zone defined by the venting walls, and a bottom wall portion closing off the bottom of the air inlet zone; right and left heat exchangers extending lengthwise along the heat exchanger assembly and respectively covering the right and left air inlets of the air flow units and respectively covering the right and left portions of the venting wall of at least one of the air flow units, a support supporting the air flow units and the heat exchangers, and coupling means for coupling the fans together for rotation in unison and in parallel, and wherein the fans are adapted to cause air flow through the right and left heat exchangers into said air inlet zones by the right and left air inlets, through the holes into the vent zones, and out the top of the vent zones. The heat exchanger assembly further comprises a top wall portion closing off the top of the front-most of the air inlet zones. Further, a front end wall closes off the front of the front-most air inlet zone, and the right and left air inlets of the front-most air inlet zone are substantially rectangular and extend vertically between the top wall portion and the bottom wall portion and extend horizontally between the front end wall and the front-most one of the fan mounting walls. The coupling means comprises at least one fan shaft extending through at least one of the holes to allow axial alignment of all of the fans. The support comprises a lower frame and a plurality of vertically extending right and left posts and the right and left heat exchangers are bolted to the respective right and left posts. A back-most of the venting walls extends backwardly beyond the back end of the support. The assembly further comprises an input shaft portion at the front end, which input shaft portion is axially in line with a common rotation axis of the fans.

BRIEF DESCRIPTION OF THE DRAWINGS

The details of the present invention will be most easily understood by considering the detailed description in conjunction with the accompanying drawings wherein like characters represent like parts throughout the several views and in which:

FIG. 1 shows a perspective view of the present invention with several parts broken away for clarity.

FIG. 2 shows a simplified side view of the present invention.

DETAILED DESCRIPTION OF THE PREFERRED EMBODIMENT

Figure 3:
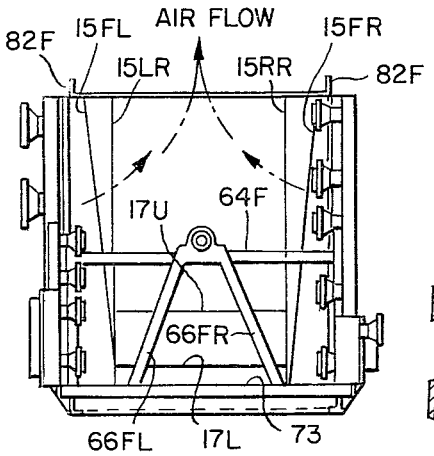
FIG. 3 shows a front end view of the present invention with some parts removed for ease of illustration.

The present invention may be considered as an improvement on the above-referenced U.S. Pat. No. 3,627,037 to Carr, which patent is hereby incorporated by reference. Accordingly, construction details which are identical or similar to the heat exchanger assembly disclosed by the Carr Patent need not be discussed in detail herein. The present specification will instead concentrate on the differences and improvements of the present invention over the heat exchanger assembly of the Carr Patent.

Turning initially to FIG. 1, there is shown a perspective view of the present invention with several parts broken away for clarity purposes. The present heat exchanger assembly 10 includes a number of similarly constructed air flow units including front air flow unit 12F, second air flow unit 12S, third air flow unit 12T, and back air flow unit 12B. Since these air flow units are constructed in identical fashion with the exception of the front end of front air flow unit 12F and the back end of back air flow unit 12B, the construction details of one air flow unit will generally be the same as another air flow unit. Each air flow unit such as air flow unit 12S includes a fan mounting wall 14S and an associated venting wall 16S. The fan mounting wall 14S includes a hole 18S in which a fan (not shown in FIG. 1) may be mounted for rotation in similar fashion to that shown in FIG. 4 of the incorporated-by-reference Carr Patent. A left air inlet 20SL is defined by the space in between the fan mounting wall 14S and the venting wall 16F of the adjacent air flow unit 12F. A similar right air inlet 20SR is situated on the right side of the heat exchanger assembly 10.

The bottom of each of the air inlet zones 22F, 22S, 22T, and 22B between the respective air inlet pairs 20FL and 20FR, 20SL and 20SR, 20TL and 20TR, and 20BL and 20BR is closed off by a bottom wall 73. Although bottom wall 73 is shown as a single wall, separate bottom walls for each air inlet zone could also be used. Top walls 72F, 72S, 72T, and 72B close off the top of the associated air inlet zones. Top wall 72F is rectangular, whereas top walls 72S, 72T, and 72B are rectangular with a trapezoid hole for accommodating the respective venting walls 16F, 16S, and 16T. Top walls 72F, 72S, 72T, and 72B are shown as separate pieces, which may be welded onto support posts 62L and 62R, but they may alternately be integral. Front end wall 70 (FIG. 1) closes off the front air inlet zone 22F (FIG. 2).

The air flow units 12F, 12S, 12T, and 12B are similar in function to the units 10, 12 and 14 in the incorporated-by-reference Carr Patent. However, the present invention uses right and left heat exchangers 40R and 40L instead of a top mounted heat exchanger. The heat exchangers 40R and 40L may be constructed in similar fashion to the top mounted heat exchanger discussed in the Carr Patent. A suggested construction for the present heat exchangers is also discussed below.

The heat exchangers 40R and 40L will preferably be bolted to a support 60 having a number of right and left posts 62R and 62L mounted at various places along its length. For simplicity's sake, only two support posts 62L are shown in FIG. 1, it being readily appreciated that numerous support posts would be located along both sides of the support 60. In particular, it is preferred to have a support post at a front end wall 70 and at the back-most fan mounting wall 14B (not shown in FIG. 1) and a support post at each of the fan mounting walls 14T, 14S, and 14F disposed between these two ends. In other words, the support posts 62L and 62R, which are preferably welded to the support unit 60, would include five support posts on each of the sides of the support unit 60. The heat exchangers 40R and 40L will be bolted to the five support posts on their respective sides.

Continuing to view FIG. 1, but also considering the side view of FIG. 2, and the end view of FIG. 3, the construction of various parts of the heat exchanger assembly will be further discussed. For simplicity's sake, FIG. 2 does not show the right side heat exchanger 40R and shows the left side heat exchanger 40L completely broken away except at the front end of the heat exchanger assembly 10. The front end wall 70 has likewise been deleted from the view of FIG. 3 as has the fan mounting wall 14F in order to better illustrate the venting wall 16F.

As shown in FIG. 2, diagonal braces such as 80 may extend between adjacent pairs of support posts 62R and 62L. If desired, a pair of crossing diagonal braces may be used between adjacent support posts. Front lift points 82F and back lift points 82B are welded to the four top corners of the heat exchanger assembly for lifting purposes.

The venting wall 16F is inclined from adjacent the bottom of the fan mounting wall 14F and extends to adjacent the top of the fan mounting wall 14S. The angle of inclination increases in steps at 17L and 17U (FIGS. 2 and 3 only). Since the venting wall 16F is preferably made of ten or twelve gauge steel, it may include points 17 wherein the angle of inclination changes. Additionally, the venting wall 16F is tapered inwardly as it extends from the fan mounting wall 14F towards the back of the heat exchanger assembly 10. As viewed from above and is apparent from FIG. 1, the venting wall 16F defines a venting zone having a trapezoidal cross section at its top, the trapezoid being defined by front right line 15FR, front left line 15FL, rear right line 15RR, and rear left line 15LR as labeled in FIGS. 1 and 3 only. As shown, the construction of venting wall 16F is such that the venting zone defined within the venting wall 16F and also bounded by the fan mounting wall 14F is wider at its top than at its bottom and is wider adjacent the associated fan mounting wall 14F. Although the heat exchanger 40L covers the venting wall 16F in addition to the left air inlet 20SL, the venting wall 16F is spaced from the heat exchanger 40L eight to ten inches at its closest part which would be at the top of line 15FL. The spacing would be greater near the bottom of the venting wall 16F and near the rear of the wall 16F due to the tapering of the venting wall from line 15FL to line 15LR. This spacing is quite advantageous because it allows maximum air flow through the heat exchangers.

Figure 6:
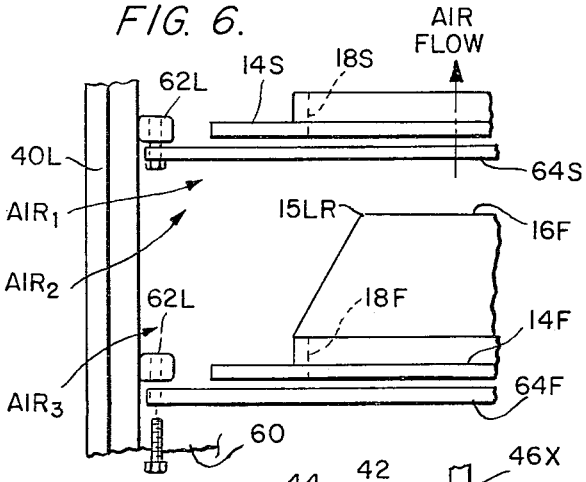
FIG. 6 shows a top view of parts of the present invention.

The importance of the spacing between the heat exchanger 40L and the venting walls such as 16F is best illustrated in FIG. 6 which shows a simplified top view of different components within the present invention. In particular, the second fan mounting wall 14S is shown longitudinally spaced from the first fan mounting wall 14F, these parts being shown for the left side only, it being readily understood that the right and left sides of the present invention are constructed identically in symmetric fashion. Likewise, venting wall 16F is shown only partially in FIG. 6 whereas the venting wall 16S is deleted for simplicity. The heat exchanger 40L is mounted to the support 60 by bolting it to the support posts 62L, the details of which will be discussed below. Since the heat exchanger 40L is spaced from the nearest point (the top of taper line 15FL) of the venting wall 16F, air flow is facilitated through substantially all of the heat exchanger 40L in spite of the fact that the heat exchanger 40L covers up the venting wall 16F. The inward tapering of the venting wall 16F from line 15FL to line 15LR facilitates air flow through the hole 18S in the fan mounting wall 14S since the air flow vector labeled $AIR_F$ has a greater component in the general direction of $AIR_3$ adjacent the close in point between the heat exchanger 40L and the venting wall 16F and has a lesser component in the general direction of $AIR_1$ wherein the heat exchanger 40L does not cover the venting wall 16F. In other words, although the fan (not shown in FIG. 6) mounted in fan mounting wall 14S might tend to induce more air flow in the location of $AIR_1$ because there is no blockage from the venting wall 16F at that location, this is somewhat counteracted by the taper in venting wall 16F because the air in $AIR_3$ will be induced due to the vector direction of the final air flow $AIR_F$. The clearance between the venting wall 16F and heat exchanger 40L decreases gradually from $AIR_1$, through $AIR_2$ to $AIR_3$ as the component of vector $AIR_F$ in a direction through heat exchanger 40L increases from $AIR_1$ through $AIR_2$ to $AIR_3$.

The coupling between the fans may be achieved by separate fan shafts 28F, 28S, 28T, and 28B in similar fashion to that disclosed in the incorporated-by-reference Carr Patent. These fan shafts may be coupled by couplers 26S, 26T, and 26B of any suitable shaft coupling design. The coupler 26S, as well as the other couplers, could be located in the position shown for 26S, as well as located in the position shown for 26S' with a floating shaft.

As best shown in FIG. 1, the end wall 70 may be secured to two end posts 62R and 62L, which posts have a horizontal beam 64 extending therebetween. Horizontal beam 64 together with right and left support legs 66R and 66L and idler 68 function in an essentially similar fashion to the arrangements shown in the Carr Patent. Additionally, and as best shown in FIG. 3, a similar horizontal beam 64F and legs 66FR and 66FL are disposed adjacent each of the fan mounting walls or fan decks such as 14F. For the ease of showing the venting wall 16F, the fan mounting wall 14F is not shown in FIG. 3, but it will be readily understood that this fan mounting wall extends vertically in parallel to end wall 70 and is mounted between support posts 62R and 62L. Of course, the fan mounting wall 14F includes a hole 18F for mounting the fan therein. Each of the fan mounting walls 14 may be bolted, welded, or otherwise attached to the corresponding horizontal beam and/or support legs such as 64F, 66FL, and 66FR. The horizontal beams such as 64S and 64F are bolted to the support posts 62L as shown in FIG. 6 and to right side support posts 62R (not shown) in similar fashion.

Figure 4:
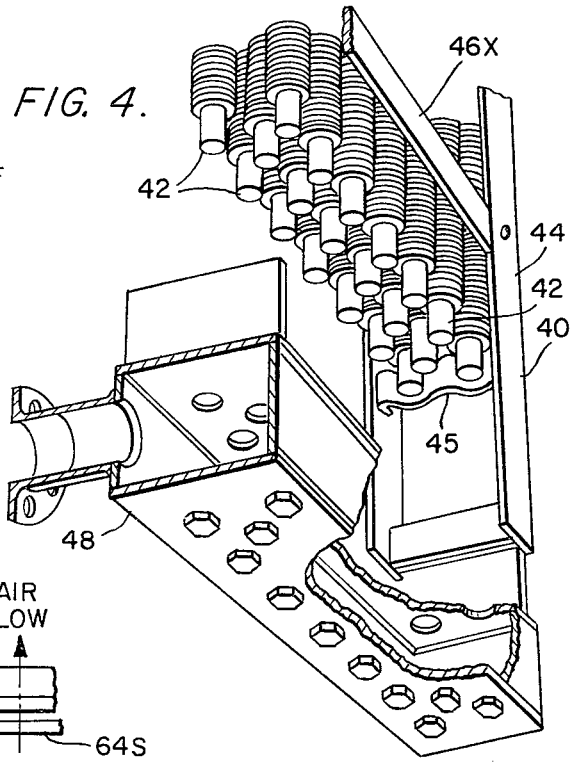
FIG. 4 shows the details of heat exchanger construction for providing a component of the present invention.

Turning now to FIG. 4, the construction of a heat exchanger for use with the present invention will be discussed. In particular, FIG. 4 shows a top perspective view in partial break-away of a heat exchanger 40 according to the present invention. A number of finned tubes 42 are constrained within a channelized bottom piece 44. A channelized top piece constructed identically to the bottom piece 44 would be located on the top side of the heat exchanger 40, but this is not shown in FIG. 4 to avoid obscuring the construction details. The channelized bottom piece 44 includes several longitudinally spaced supports 45 (only one being shown) to prevent the tubes 42 from dropping to the bottom of the channel of piece 44. A number of rungs 46X (only one being shown) are spaced lengthwise along the channel member 44. A header section 48 for use in inputting and outputting fluid to the various tubes 42 is constructed as shown.

Figure 5:
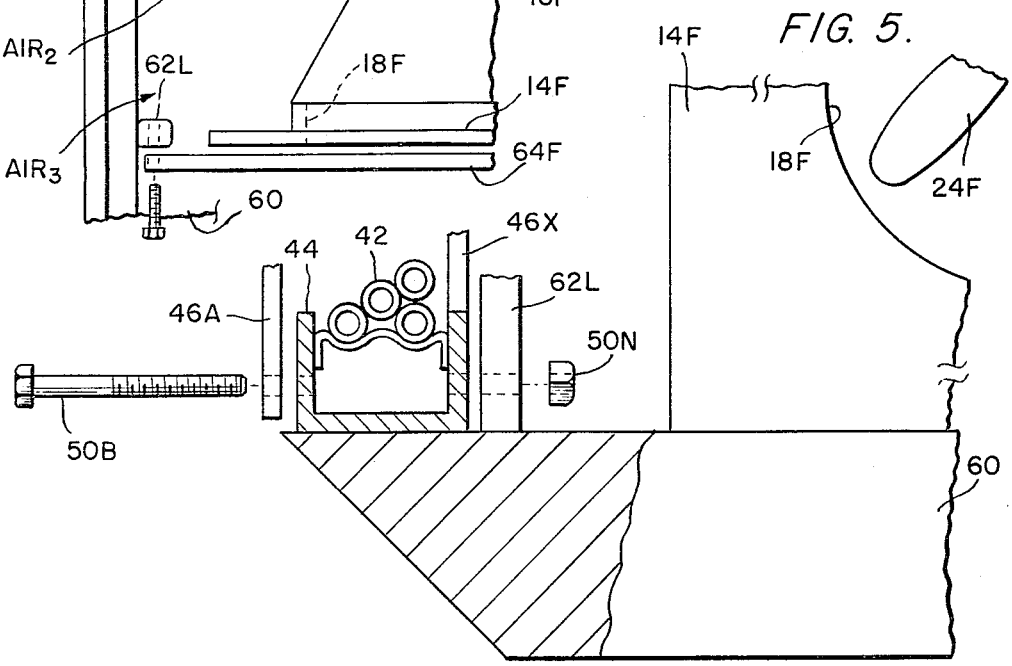
FIG. 5 shows an end view in partial cross section of parts of the present invention showing how heat exchangers are bolted to the support of the present invention.

Continuing to consider FIG. 4, but also viewing FIG. 5, showing a cross-section along lines 5—5 of FIG. 2, the mounting of the heat exchanger 40 to the heat exchanger assembly of the present invention will be discussed. In particular, the support 60 is shown in cross section in FIG. 5 and includes a number of left support posts 62L which extend upwardly therefrom. An attachable rung 46A may be bolted to the channelized edge number 44 in order to hold the tubes 42 in place. The pieces 46X and 46A are referred to as rungs since the bottom channel edge member 44 and a corresponding top channel edge member with the rungs 46X extending therebetween would appear quite similar to a ladder. Likewise, the rungs 46A which may be opposite each of the rungs 46X and spaced longitudinally along the channel member 44 in similar fashion to the rungs on a ladder, could be fixed to the channelized member 44 or as shown could be attachable by bolting. As shown in FIG. 5, a bolt 50B may be used to bolt the outer or attachable rung 46A to the channel member 44 and to the support post 62L, a nut 50N being used to secure the bolt. The support piece 45 is used to keep the tubes 42 above where the bolt 50B extends through the channel member 44. As an alternate construction, the rungs 46A may be bolted to the channel member 44 by different bolts than those used to bolt the heat exchanger 40L including the channel member 44 to the support post 62L. Further, the rings 46A could be bolted into the inside (i.e., rest in the channel) of channelized member 44. A grid of screening (not shown) may be used on each side of heat exchanger 40L. In addition to having the outer or attachable rungs 46A to a top channel member similar to the bottom channel member 44, such a top channel member would likewise be bolted to the support post 62L. Additionally, the support post 62L may include a series of holes at various heights thereof such that one heat exchanger unit may be stacked on top of another heat exchanger unit and separately bolted to the support post 62L (or for the right side support post 62R). The fan 24F is partially shown in FIG. 5.

OPERATION

The operation of the present invention is relatively straightforward. The front fan shaft 28F serves as a drive shaft and may be driven directly or by way of idler 68. The coupling means comprising the various couplers 26 and the fan shafts 28 will cause the fans (one in each of the fan mounting walls 14) to rotate as long as the couplers 26 are disposed for coupling the fan shafts 28.

Air will be induced to flow into the air inlet zones 22 through the left and right air inlets 20, this air being drawn through the left and right heat exchange units 40. The air then flows through the holes 18 in the various fan mounting walls 14 and into the venting zones defined within the venting walls 16 and also bounded by the fan mounting walls 14. The venting walls 16 deflect the air upwardly whereupon the heat is effectively dissipated from fluids flowing through the heat exchange units mounted along the side of the heat exchange assembly 10.

If a particular application does not require the complete capacity of the heat exchange assembly 10, the couplers 26 may be decoupled to lighten the load on the motor which drives the fans. The decoupled fan or fans may be easily recoupled when additional heat dissipation capacity is required.

It will be noted that each of the air flow units 12 including the associated venting wall 16 and air inlets 20, is constructed identically except the respective front and back air flow units 12F and 12B. In particular, the front air flow unit 12F includes a larger air inlet zone 22F than the other air flow units since there is no venting wall 16 extending towards the front air flow unit 12F. In particular, and as best shown in FIG. 2, the right and left air inlets 22FR and 22FL are substantially rectangular and extend vertically between a top wall portion 72F and the bottom wall 73. These air inlet zones further extend horizontally between the front end wall 70 and the front-most fan mounting wall 14F.

In contrast to the generally rectangular top wall portion 72F which closes off the air inlet zone 22F of the front air flow unit 12F, the remaining top wall portions 72S, 72T, and 72B include holes for passage of air exiting the venting walls 16. That is, these remaining top wall portions 72S, 72T, and 72B include trapezoidal holes for passage of air exiting the venting walls 16.

The venting wall 16B is somewhat dissimilar from the remaining venting walls in that it extends beyond the back end of the support 60 and it extends beyond the back end of the heat exchangers 40L and 40R. Accordingly, this venting wall 16B might, if desired, be shaped somewhat differently since there is little problem of this venting wall 16B blocking air flow to the heat exchanger units 40R and 40L. It will be recalled that the inward tapering of the venting walls 16 as they extend backwardly is used to minimize any blockage of air flow through the heat exchangers by virtue of the proximity of the venting walls 16. Obviously, these features are not necessary in the case of the venting wall 16B since this venting wall would not block air flow through any of the heat exchangers.

Although the present invention may be implemented in various sizes, the preferred embodiment contemplates a width of slightly less than 14 feet, a height of slightly more than 10 feet and a total length of slightly under 50 feet.

Although various details have been disclosed herein, it is to be understood that these are for illustrative purposes. Various modifications and adaptations will be readily apparent to those of ordinary skill in the art. Accordingly, the scope of the present invention should be determined by reference to the claims appended hereto.

What is claimed is:

1. A heat exchanger assembly for air-cooled heat exchanging and having a top, a bottom, a front end, a back end, a right side and a left side:

(a) a plurality of air flow units arranged and supported in a longitudinal end-to-end assembly, each air flow unit including the following associated components:
  (i) a substantially vertical fan mounting wall having a hole therein;
  (ii) a fan mounted for rotation in said hole,
  (iii) a venting wall operative to direct air blown backwardly by said fan up and out said top, said venting wall situated in back of said fan mounting wall and including right and left portions and an inclined portion extending from adjacent the bottom of said fan mounting wall to the top of said heat exchanger,
  (iv) right and left air inlets situated in front of said fan mounting wall,
  (v) an air inlet zone between said right and left air inlets from which air is drawn to said fan, through said hole, and into a venting zone defined by said venting walls, and
  (vi) a bottom wall portion closing off the bottom of said air inlet zone, (b) right and left heat exchangers extending lengthwise along said heat exchanger assembly and respectively covering said right and left air inlets of said air flow units and respectively covering said right and left portions of said venting wall of at least one of said air flow units, (c) a support supporting said air flow units and said heat exchangers, and (d) coupling means for coupling said fans together for rotation in unison and in parallel and wherein said fans are adapted to cause air flow through said right and left heat exchangers into said air inlet zones by way of said right and left air inlets, through said holes into said vent zones and out the top of said vent zones and wherein said right and left portions of the venting walls of more than one of said air flow units are tapered inwardly and backwardly.

2. The heat exchanger assembly of claim 1 further comprising a top wall portion closing off the top of the front-most of said air inlet zones.

3. The heat exchanger assembly of claim 2 further comprising a front end wall closing off the front of said front-most air inlet zone.

4. The heat exchanger assembly of claim 3 wherein said right and left air inlets of said front-most air inlet zone are substantially rectangular and extend vertically between said top wall portion and said bottom wall portion and extend horizontally between said front-end wall and the front-most one of said fan mounting walls.

5. The heat exchanger assembly of claim 1 wherein said coupling means comprises at least one fan shaft extending through at least one of said holes to allow axial alignment of all of said fans.

6. The heat exchanger assembly of claim 5 wherein said coupling means comprises a separate fan shaft for each of said fans and coupler(s) for coupling adjacent ones of said fan shafts.

7. The heat exchanger assembly of claim 1 wherein said support comprises a lower frame and a plurality of vertically extending right and left posts, and said right and left heat exchangers are bolted to the respective right and left posts.

8. The heat exchanger assembly of claim 7 further comprising a top wall portion closing off the top of the front-most of said air inlet zones.

9. The heat exchanger assembly of claim 7 further comprising a front end wall closing off the front of said front-most air inlet zone.

10. The heat exchanger assembly of claim 9 further comprising a top wall portion closing off the top of the front-most of said air inlet zones, and wherein said right and left air inlets of said front-most air inlet zone are substantially rectangular and extend vertically between said top wall portion and said bottom wall portion and extend horizontally between said front-end wall and the front-most one of said fan mounting walls.

11. The heat exchanger assembly of claim 10 wherein said coupling means comprises a separate fan shaft for each of said fans and coupler(s) for coupling adjacent ones of said fan shafts.

12. The heat exchanger assembly of claim 11 wherein a back-most of said venting walls extends backwardly beyond the back end of said support.

13. The heat exchanger assembly of claim 7 wherein a back-most of said venting walls extends backwardly beyond the back end of said support.

14. The heat exchanger assembly of claim 7 further comprising an input shaft portion at said front end and axially in line with a common rotation axis of said fans.

15. The heat exchanger assembly of claim 1 wherein a back-most of said venting walls extends backwardly beyond the back end of said support.

16. The heat exchanger assembly of claim 1 further comprising an input shaft portion at said front end and axially in line with a common rotation axis of said fans.

17. The heat exchanger assembly of claim 16 further comprising an input coupler coupling said input shaft portion to a fan shaft on which the front-most of said fans is mounted, said input coupler is in the front-most of said air inlet zones.

18. The heat exchanger assembly of claim 1 further comprising a plurality of vertically extending right and left support posts and said right and left heat exchangers are bolted to the respective right and left support posts.

* * * * *